United States Patent [19]

Exley et al.

[11] 4,315,714

[45] Feb. 16, 1982

[54] ROTARY COMPRESSORS

[75] Inventors: John T. Exley, Milford; Charles Kuintzle, Jr., Monroe; David L. Tate, Stratford, all of Conn.

[73] Assignee: Avco Corporation, Stratford, Conn.

[21] Appl. No.: 970,416

[22] Filed: Dec. 18, 1978

Related U.S. Application Data

[60] Division of Ser. No. 795,058, May 9, 1977, Pat. No. 4,164,845, and a continuation-in-part of Ser. No. 515,115, Oct. 16, 1974, abandoned.

[51] Int. Cl.[3] ..... F04D 29/54

[52] U.S. Cl. ..... 415/207; 415/DIG. 1

[58] Field of Search ..... 415/26, 27, 28, 144, 415/145, 207, DIG. 1

[56] References Cited

U.S. PATENT DOCUMENTS 3,414,188 12/1968 Gallie ..... 415/144

3,694,102 9/1972 Conrad ..... 415/DIG. 1

*Primary Examiner*—Leonard E. Smith

*Attorney, Agent, or Firm*—Ralph D. Gelling

[57] ABSTRACT

A flow stabilizer is presented which equalizes the flow of fluid through the passageways of the channel diffuser used with a centrifugal type rotary compressor. Slots are formed in the sidewalls of the flow separating vanes in the diffuser. The slots open into cavities within the vanes. The multiplicity of cavities communicate by means of openings through the diffuser wall into a common closed manifold. The fluid interconnection between the multiplicity of passageways in the diffuser and the encircling common manifold increases the operating range of the compressor since pressure surges in one or more passageways are quickly equalized.

3 Claims, 9 Drawing Figures

FIG 1
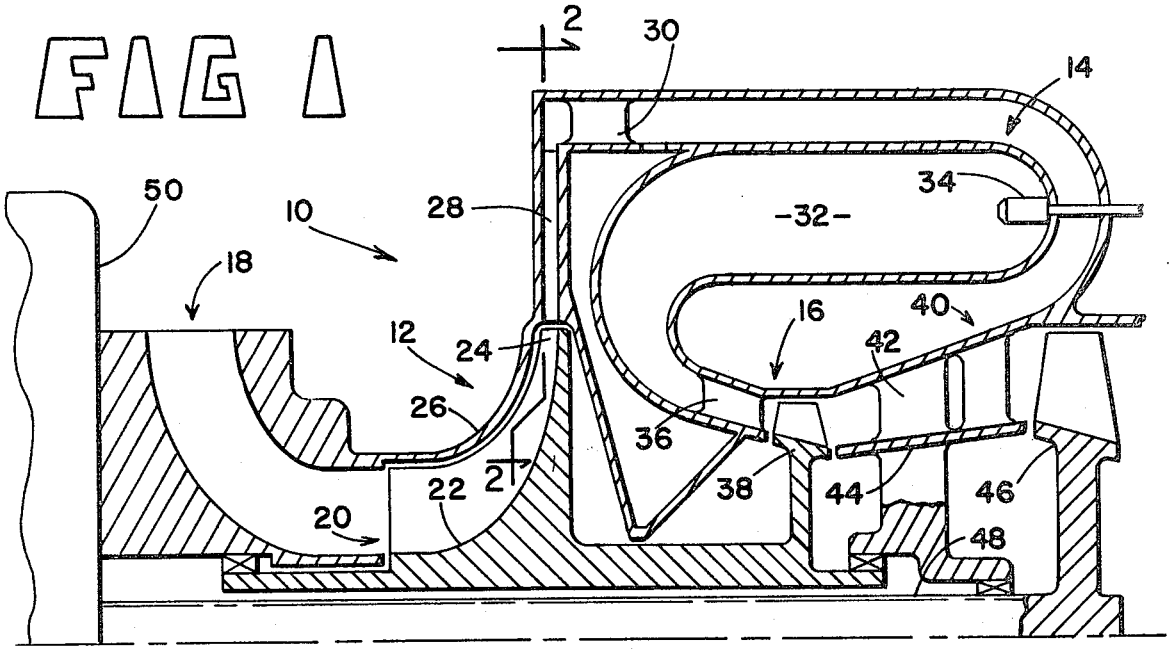
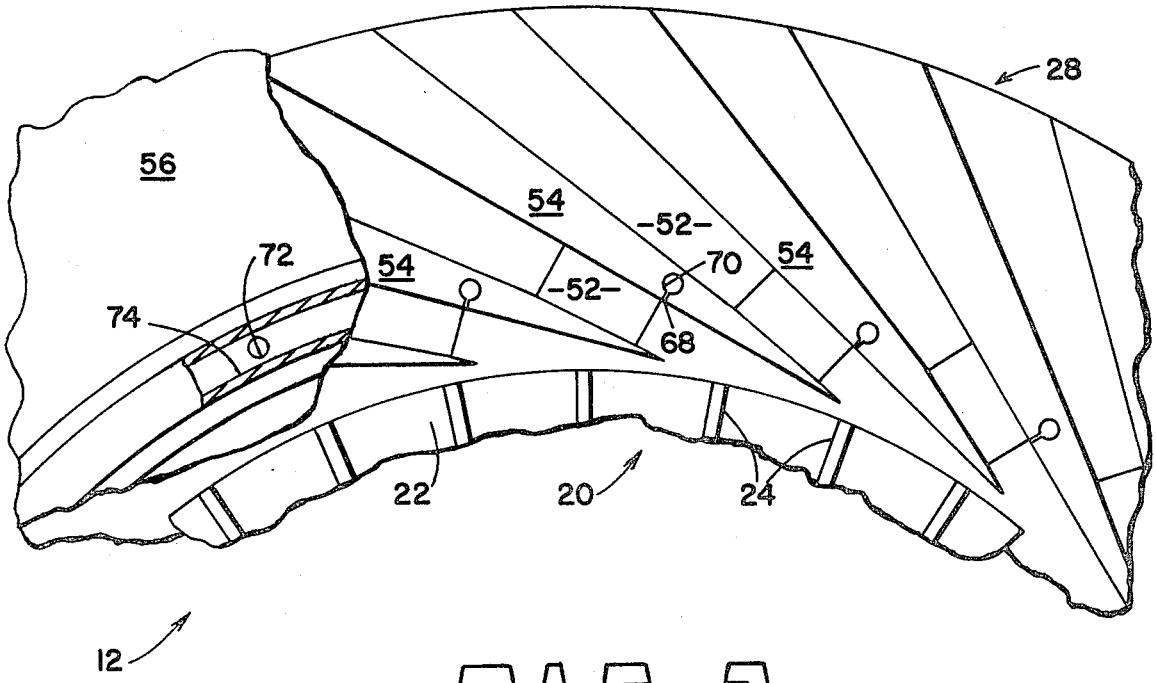
FIG 2

FIG 6
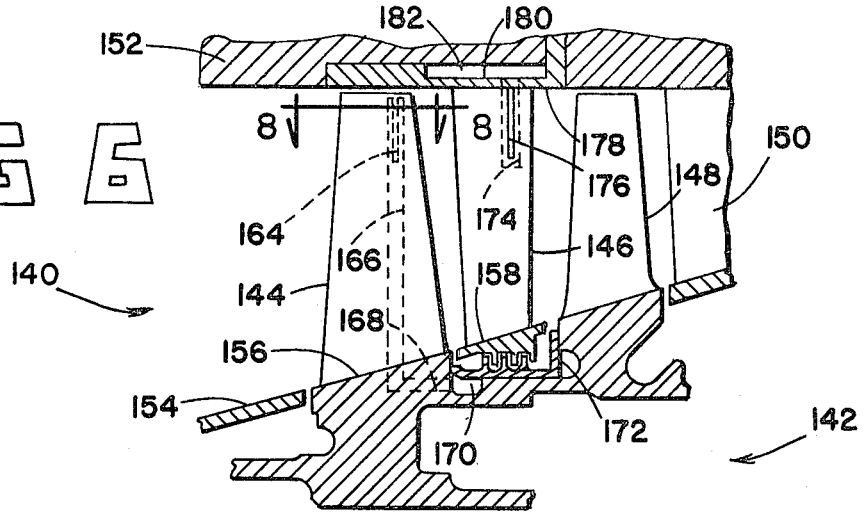
FIG 7
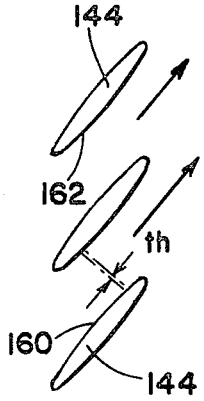
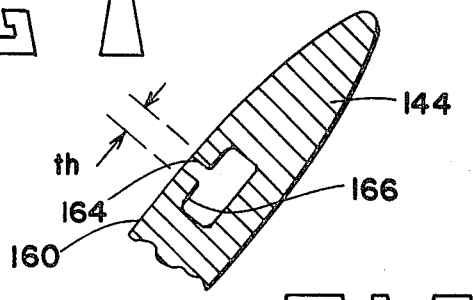
FIG 8
FIG 9
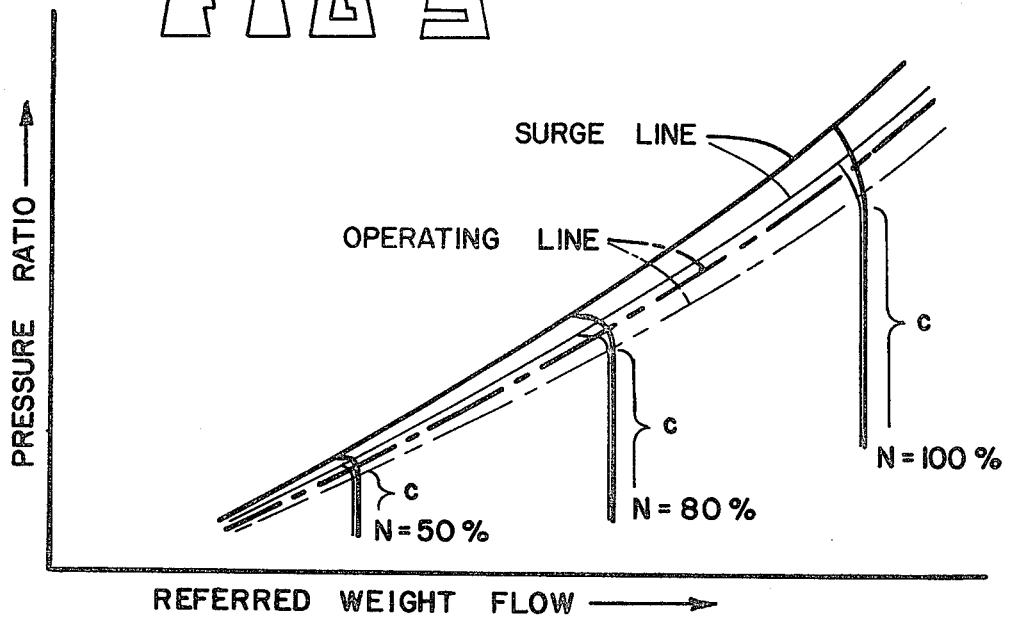

ROTARY COMPRESSORS

This is a division of application Ser. No. 795,058, filed May 9, 1977, now U.S. Pat. No. 4,164,845, which is a continuation-in-part of Ser. No. 515,115, filed Oct. 16, 1974, now abandoned.

BACKGROUND OF THE INVENTION

Our invention relates to improvements in the diffusers used with gas turbine engines, particularly high performance engines as are employed in the propulsion of aircraft. In such engines, the diffuser and associated compressor are essential components for pressurizing air as a preliminary step in the generation of a high energy, hot gas stream.

Rotary type compressors are often used for this purpose and comprise an impeller, or rotor, which imparts energy to the air, primarily in the form of increased velocity. The high velocities of the air discharged from the exit side of the impeller are too great for practical utilization in supporting combustion of fuel. Therefore, it is accepted practice to provide a diffuser immediately downstream of the impeller. The diffuser decelerates the discharge air to relatively low velocities and converts a major portion of the velocity energy to static pressure energy. In most compressors, the impeller, or rotor, has projecting blades over which the air flows in discrete paths as it is accelerated thereby. Likewise, the diffuser, or stator, has vanes which split the high velocity discharge air into discrete flow paths.

A major problem in the operation of compressors is the phenomenon known as surge. When this condition occurs, flow of air through the compressor is throttled, either locally or completely, and in some cases reverse air flow can occur. The result of compressor surge is a reduction in power in all cases and frequently a flame-out of the combustor, in which case there is a complete loss of power.

Surge will occur, at a given engine speed, when the aerodynamic loading on the blades or vanes exceed a given limit, causing separation of the air from the flow passageway surfaces and a condition of high turbulence. This limit varies between different compressor designs and is established for each compressor design by way of what is known as a compressor map. Knowing the characteristics of a given design, it is then possible to control the operation of the engine, primarily through the rate of fuel flow to the combustor, so that there is a margin of safety in both steady state and transient operation.

Several different approaches have been used to solve the surge problem. Conrad in German Pat. No. 1,938,132 and British Pat. No. 1,043,168 show implementations wherein pressure is bled from a higher to a lower level to prevent build up of shockwaves in the diffuser passageway throats. The pressure bleed off is achieved by means of connecting pipes which either recirculate the fluid to a lower pressure point in the system or vent it.

O'Connor in U.S. Pat. No. 3,768,919 shows a pipe diffuser with an aerodynamically variable throat area. A series of ports are provided in the throat region of the diffuser passages to momentarily inject pressurized diffuser exit air to aerodynamically vary the throat flow characteristics and prevent surge during operation of the stage above its normal surge line.

Sobey in U.S. Pat. No. 3,006,145 shows an antisurge control system which makes use of a compressor bleed system. He uses a bleed valve which is responsive to both compressor rotor speed and acceleration of the compressor rotor.

Our invention differs from the above in that we provide slots in the sidewalls of the throat section of each vane of the diffuser. These slots communicate through cavities in each vane with a closed manifold. The benefits achieved by the use of a closed manifold have been verified by means of test instrumentation Data taken from operating diffusers shows that shock waves tend to build up in the throat areas of some passageways before they do in others. This may be due to imperfections in the vanes or can be caused by the shadow effects of strut vanes in the compressor stages. Use of a closed manifold in communication with slots in the passageway walls alleviated the problem in that tendencies for pressure surges in one or more passageways was quickly equalized across all passages through flow into and out of the connecting manifold. This phenomenon was never mentioned in any of the cited patents.

SUMMARY OF THE INVENTION

While relating to compressor assemblies generally, this invention will be described as it relates to a compressor stage having a bladed radial flow impeller and an annular radial flow diffuser having its inner periphery closely surrounding the discharge end of the impeller. The inlet of the diffuser includes a vaneless entrance space for receiving fluid discharged from the impeller.

The entrance space is formed by spaced apart walls which are coextensive with the impeller shroud. Between the spaced apart walls of the diffuser are a multiplicity of wedge-shaped vanes. These vanes are symmetrically disposed, adjacent vanes forming therebetween a plurality of intersecting passageways which extend outwardly from the annular entrance space in a direction that is tangential with the inner periphery of the diffuser.

Each passageway has a convergent entrance portion immediately adjacent the vaneless annular entrance. This is followed by a throat section of constant cross section. Downstream of the throat section, each passage opens into an area of expanding cross section wherein fluid velocity is exchanged for an increase in pressure. The divergent section of each passageway terminates in an exhaust manifold.

Our invention pertains to the incorporation of flow equalization for preventing surge and stabilizing fluid flow through the diffuser passageways. Flow equalization was achieved by forming slots in the inward facing wall of each wedge-shaped vane. Each slot communicated with a cavity inside each vane. Openings made through one of the spaced apart walls of the diffuser allowed the multiplicity of cavities to communicate with a closed common manifold. Several slot locations and configuration were tried as will be described later. However, the preferred approach involved forming transverse slots in the throat section of each passageway.

Inclusion of a common manifold in communication with slots in the low pressure side of each vane allowed fluid to flow into and out of the manifold via the multiplicity of cavities within the vanes, thereby serving to equalize the pressure in all of the passageway throat sections. This greatly improved surge margin performance.

Shaping of the slots can affect performance. Several configurations were tried and embodiments which function best are delineated. It is the concept of pressure equalization by means of a closed common manifold in combination with cavities and slots which communicate with each of the diffuser passageways that is the heart of our invention.

Previous proposals for so increasing the surge or operating range of a given compressor design have either involved undue performance penalties in terms of efficiency or have been of limited effectiveness, or both. Accordingly, the primary object of the present invention is to increase the surge range of rotary compressors for pressurizing compressible fluids.

Another object of the present invention is to increase such surge range with a minimum adverse affect on compressor or engine cycle efficiency, if not, in fact, obtaining an increase in such efficiency.

Another object of the present invention is to minimize the occurrence of surge in both the rotating and stationary components of compressors, whether the radial flow or axial flow type.

In the broader aspects of the invention, these ends are attained by a compressor comprising a rotor component and a relatively stationary diffuser component, which together form a compressor stage. At least one of these components comprises a plurality of flow passageways divided by spaced vanes. The sidewalls of the diffuser vanes produce passageways which together form a throat section downstream of the leading edges of the vanes. Slots are provided in the throat section walls. The slot openings connect with cavities in each vane. The cavities are then interconnected with a closed manifold encircling the outside wall of the diffuser. By thus interconnecting the flow passageways, surge causing conditions are equalized between the several flow passageways. Where flow conditions might have caused surge in a given passageway which could build up and propagate to all passageways, the manifold interconnection relieves such conditions to the end that individual passageways are not aerodynamically overloaded and the surge range and operating range are appreciably increased. The increased surge range enable operation at higher pressure ratios with a resultant increase in compressor and engine cycle efficiency, while the increase in operating range gives a greater margin of safety in engine operation.

The slots are preferably disposed along a line of equal pressure within each passageway throat section. The slots may be advantageously located on the vane suction surfaces. Slots may also be employed on more than one surface of the flow passageways. In axial flow compressor rotors, the slot means are preferably located at the tip end portions of the vanes which define the flow passageways thereof. The slots are also effective in so-called pipe diffusers.

The interconnecting manifold may also be bled to a lower pressure during critical portions of engine operation, such as acceleration, to temporarily provide an even greater increase in the operating range of the compressor.

The above and other related objects and features of the invention will be apparent from a reading of the following description of the disclosure, with reference to the accompanying drawings, and the novelty thereof pointed out in the appended claims.

BRIEF DESCRIPTION OF THE DRAWINGS

In the drawings:

FIG. 1 is a simplified, longitudinal, half section of a gas turbine engine of the type in which the improved compressor of the present invention may be advantageously incorporated;

FIG. 2 is a view, on an enlarged scale, taken generally on line 2—2 in FIG. 1;

FIG. 6 is a longitudinal section of a portion of an axial flow compressor in which the present invention is embodied;

FIG. 7 illustrates a flow cascade of rotor blades seen in FIG. 6;

FIG. 8 is a section, on an enlarged scale, taken on line 8—8 in FIG. 6; and FIG. 9 is a plot of compressor operating parameters known as a compressor map.

DESCRIPTION OF THE PREFERRED EMBODIMENT

Figure 3:
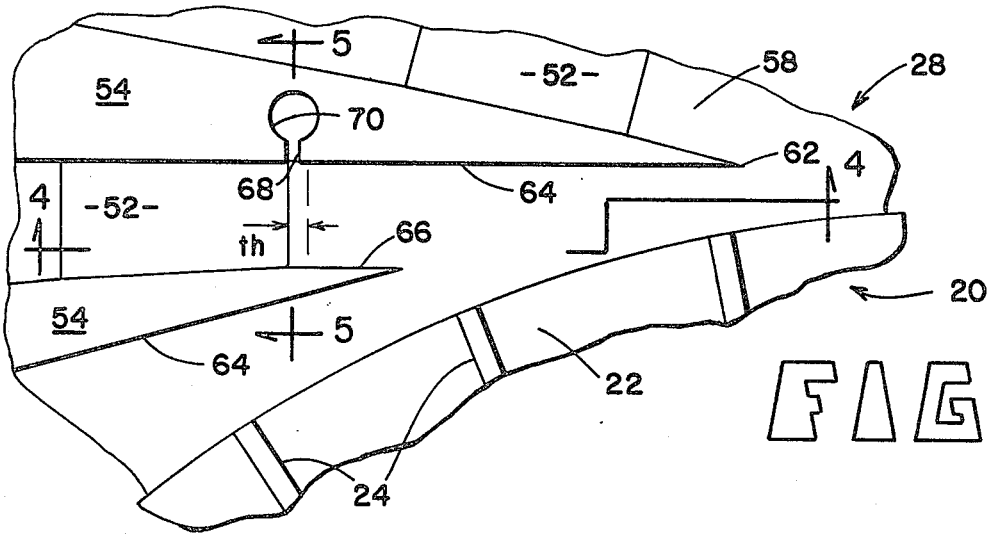
FIG. 3 is a view, on a further enlarged scale, of a portion of the diffuser seen in FIG. 2, more particularly illustrating the invention.

Reference will first be made to FIG. 1 for a description of a gas turbine engine of the type in which the present invention finds particular utility. Such engines are well known to those skilled in the art and FIG. 1 is therefore greatly simplified, omitting structural details.

The gas turbine engine, indicated generally by reference character 10, comprises, as basic units, a radial flow compressor 12, a combustor 14, and a turbine 16, which are sometimes collectively referred to as a gas generator.

Air is induced into the compressor 12 through an inlet 18 which turns it into an axial direction for entrance into the compressor 12. The latter comprises an impeller 20 having a hub 22 and blades 24. The hub 22 and a surrounding shroud 26 define an annular flow path which curves from the axially facing entrance to a circumferential, radial exit, with the flow path being progressively reduced in area towards the radial exit. As the impeller rotates, the blades 24, which are in close clearance relationship with the shroud 26, propel the air at increasing velocities and discharge it circumferentially of the radial exit at substantially increased total pressures.

The impeller discharge air then enters a radial flow diffuser 28 from which it is turned to an axial direction and enters an axial diffuser, or guide vanes, 30 which properly direct the pressurized air to the combustor 14, which is of the reverse flow type. The pressurized air flows into an annular combustion chamber 32 where it supports combustion of fuel discharged from fuel nozzles 34, in the generation of a high energy, hot gas stream. This hot gas stream is then turned inwardly through an angle of approximately 180° to the nozzle diaphragm 36 of the turbine 16. The hot gas stream is then directed through a bladed turbine rotor 38 which is directly coupled to the compressor impeller 20. The turbine extracts a portion of the energy of the hot gas stream in thus driving the compressor impeller of the gas generator.

The majority of the remaining energy of the hot gas stream is then converted to a useful output, as by being discharged through a propulsion nozzle, or, as herein illustrated, by driving a power turbine 40. The latter comprises a nozzle diaphragm 42, mounted on a frame member 44, which directs the hot gas stream through a bladed turbine rotor 46. The power turbine rotor 46 is mounted on a forwardly extending shaft 48, which, generally speaking, has a rate of rotation too great to be directly coupled to a driven unit. Therefore it is usual practice to provide a gear box 50 on the front end of the engine 10. The input to this gear box, from shaft 48, is reduced in speed to a much lower rotational rate and motive power then derived from an output shaft (not shown) of the gear box.

Reference will also be had to FIG. 2 for a more detailed description of the compressor 12. The impeller blades 24 are preferably formed integrally with the hub 22 and have their trailing edges at the periphery of the hub. The impeller discharge exit thus extends circumferentially of the impeller with a width, in an axial direction, from the hub side to the shroud side of the blades 24, generally between parallel planes normal to the impeller axis.

Figure 4:
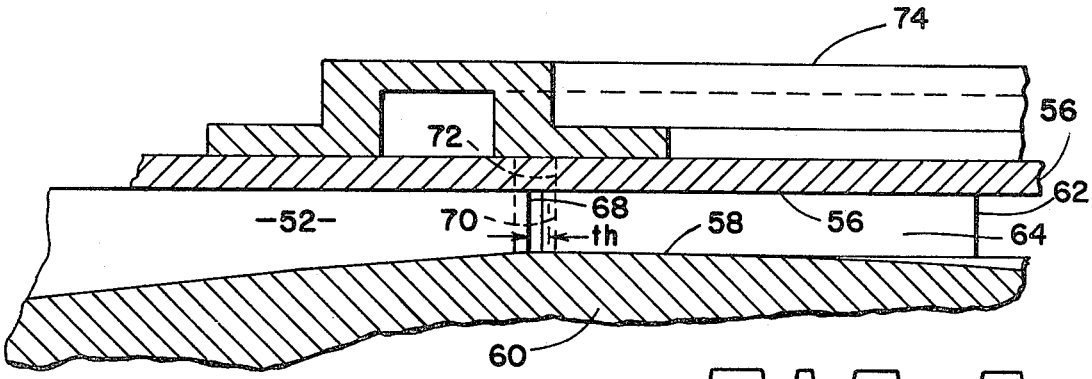
FIG. 4 is a section taken on line 4—4 in FIG. 3.
Figure 5:
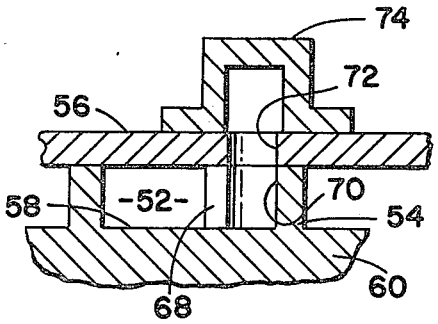
FIG. 5 is a section taken generally on line 5—5 in FIG. 3.

The exit velocities at the impeller discharge are very high and in advanced compressor designs are usually supersonic. The diffuser 28 is therefore provided to efficiently convert a major portion of the velocity energy of the impeller discharge air to static pressure energy as the flow rate is reduced to a much lower velocity, compatible with the operational characteristics of the combustor 14. The diffuser 28 may be of conventional design in having a plurality of tangentially extending flow passageways, or channels, 52 which are defined by wedge shaped vanes 54 disposed between a front wall 56 and a rear wall 58 (see also FIGS. 4 and 5). The front diffuser wall 56 may be formed as an extension of the shroud 26 and is generally aligned with the shroud sides of the trailing edges of the impeller blades 24. The rear diffuser wall 58 may be formed by a frame member 60 and is generally aligned with the hub sides of the blades 24.

The circumferential, air discharge from the impeller 20 is split into discrete flow paths by the leading edges 62 of the vanes 54 to enter the channels 52, which are of rectangular cross section. Each channel 52 has a slightly convergent entrance portion leading to a throat section th (FIGS. 3 and 4) downstream of which the cross sectional area increases in a controlled fashion to obtain a maximum reduction of velocity and recovery of static pressure in a mimimum of flow path length.

The vanes 54, or at least the upstream portion thereof, function as airfoils having suction surfaces 64 and pressure surfaces 66. Nominally there is a zero degree incidence angle of the air impinging on the suction surfaces 64. Variations in static pressure gradient (related to flow velocity) and incidence angle beyond certain limits will result in flow separation of the air and cause an increase in the thickness of the boundary layer of air along the suction surfaces. Beyond certain limits such increases tend to reduce the mass flow rate of the air for a given engine speed, until a turbulent separation of the air from the channel surfaces, particularly the suction surfaces, occurs. This can then result in a surge condition. The net effect of surge is to throttle or block air flow and in some cases, due to the dynamics of the compressible fluid, i.e. air, there will be reverse flow through the compressor. Surge is usually initiated in one or a few flow channels and then, due to the resultant pressure and flow perturbations, propagates to adjacent channels until surge exists in the entire compressor. While isolated pockets of flow separation, or stall can exist for a period of time, it is usual for a surge condition to propogate rapidly, if not instantaneously, causing a flameout in the combustor and complete loss of engine power. This result in the propulsion of an aircraft can be quite serious, or even catastrophic.

The basic flow parameters of velocity and incidence angle are proportionate, at any engine operating speed, to the pressure ratio across the compressor and the mass flow of air therethrough. These latter parameters can be measured directly or indirectly to control engine operation, usually by means of the rate of fuel flow to the combustor, so as to avoid conditions which will initiate surge. These relationships, which vary between different compressor designs, are commonly represented by what is known as a compressor map, a typical compressor map being shown in FIG. 9. This map depicts the relationship between the referred weight flow, or mass flow rate, and the pressure ratio across the compressor at three engine speeds (N) of 50%, 80% and 100%, by the thin lines on the map. It will be noted that mass flow remains constant, at a given engine speed, as the pressure ratio increases through a choke flow range c and then decreases until surge occurs at the point indicated on the thin surge line on the map. The surge line is a plot of an infinite number of engine speeds at which surge occurs.

In order to avoid conditions which would result in surge, normal engine operation is maintained at a pressure ratio approximately at the upper end of the choke flow range at any given speed. A plot of an infinite number of such operating points produces the thin broken operating line for a typical conventional compressor. The margin between the surge line and the operating line for steady state operation protects against abnormal conditions which might affect air flow or pressure ratio and also provides for safe and rapid surge free engine acceleration.

A measure of compressor performance is its operating range, a preferred definition of which is $$\text{Operating Range} = \frac{(\text{Mass Flow})_{choke} - (\text{Mass Flow})_{surge}}{(\text{Mass Flow})_{choke}} \times 100\%$$

By increasing the operating range of the compressor, increased performance is available without the danger of surge.

The means now to be described increase the operating range and raise the surge line or surge range of the typical compressor whose performance has been reflected by the thin lines in FIG. 9.

Referencing again FIGS. 2–6, a slot 68 extends along the height of each channel suction surface 64 at the throat section th. The slot 68 extends into the vane 54 to a cavity 70 which opens into a passageway 72 formed in the overlying front wall 56. The passageways 72, in turn, open into a manifold 74 which is mounted on the front wall 56. All of the slots 68 are thus placed in fluid communication with each other by way of the cavities 70 and the common manifold 74.

The effect of these interconnected slots on compressor performance is illustrated in FIG. 9 by the thick speed lines (N) showing that higher pressure ratios are attained before surge occurs at the thick surge line on this compressor map. With the surge range thus increased the operating line of the compressor can also be raised, as indicated by the thick broken line on the map, enabling normal operation at higher pressure ratios.

Compared with a bare compressor configuration, the performance of which is indicated by the thin lines in FIG. 9, the described slotted configuration, the performance of which is indicated by the thick lines in FIG. 9, increases the operating range at all speeds and, at least at speeds of N=80% to N=100% provides increased peak efficiencies, as well as increased pressure ratios on both the operating line and the surge line. For example at N=80% the operating range is 20.5% compared to a base of 11.0% and at N=100% the operating range is 10.7% compared to a base of 7.5%.

The underlying reasons for the improved results obtained are believed to be twofold. It is a known fact that surge generally initiates in one or a few channels, or flow passageways, due to manufacturing tolerance variations between the several channels, or because of transient variations in air flow or because of conditions affecting flow which are unique to one or a few channels. These factors cause the vanes of such channels to be aerodynamically overloaded and surge results. Initial overloading is first relieved by the plenum effect of the cavities 70 in the transient initiation of surge. The fluid communication provided by the manifold 74 then provides a steady state equalization of pressures to the end that a critical channel or channels continue to have favorable vane loadings up to the point where essentially the entire stage becomes overloaded and surge occurs simultaneously in all channels, but at a higher pressure ratio than would have otherwise been obtainable. It would be added that the manifold itself, in certain configurations, could provide the plenum effect for transient pressure perturbations.

The invention is illustrated in FIGS. 6–8. FIG. 6 shows, in simplified fashion, a portion of an axial flow compressor 140. This type of compressor is well known to those skilled in the art and is employed for the same basic function in gas turbine engines as the radial flow compressors which have been previously described. The configuration of gas turbine engines incorporating axial flow compressors is also well known to those skilled in the art.

The compressor 140 comprises a rotor 142 having a circumferential row of blades 144 projecting generally radially relative to its axis of rotation. Immediately downstream of the blades 144 is a circumferential row of stator vanes 146 which function as a diffuser and together with the blades 144 form a compressor stage. A second row of blades 148, mounted on the rotor 142, and stator vanes 150 form a second compressor stage, it being usual that axial flow compressors comprise several stages. The air flow path through the compressor 140 is annular and generally concentric of the axis of rotation of the rotor 142. This flow path is defined, at its outer bounds, by a composite casing 152, with its inner bounds being defined by an inlet conical member 154, platforms 156 at the bases of the blades 144, a liner 158 at the inner ends of the vanes 146 and the platforms and inner liners of subsequent stages. The blades 144 and vanes 146 function as airfoils, defining separated flow passageways and are aerodynamically equivalent to the impeller blades 24 and diffuser vanes 54 in imparting velocity energy to the air and then recovering static pressure energy. FIG. 7 illustrates a flow cascade of the blades 144 indicating that each flow passageway is defined by blade suction surfaces 160 and pressure surfaces 162 leading to a throat section th. Surge problems are equivalent in that when the blades 144 are overloaded, separation of the air flow occurs and surge results.

Again interconnected slot means are provided. Each blade 144 has a slot 164 extending along its suction surface 160. Since surge is usually a problem where peripheral speeds are greatest, the slots 164 are provided in the tip end portions of the blades 144, where they extend in a generally radial direction along the throat section th. The slots 164 open into cavities 166 which extend inwardly to passageways 168 which connect with a manifold chamber 170. The manifold chamber 170 is defined by a seal member 172 which overlies a groove formed annularly in the rotor 142. The seal member cooperates with sealing grooves on the liner 158 to provide a fluid seal between the first and second compressor stages.

The manifold chamber 170 provides a fluid interconnection between the several flow passageways defined by the blades 144 and will likewise relieve overloaded blade surfaces to deter initiation of surge.

Slot means may also be provided in the diffuser vanes 146 as is indicated in FIG. 6. Again these slots are provided in the regions of highest velocity. Slots 176 extend along the suction surfaces of the vanes 146 at their outer end portions and at their throat sections or their location of highest loading if it is not at the throat section. The slots 176 open into cavities 174 formed in the vanes 146 and extending through an outer liner 178 which is a part of the composite casing 152. The outer liner 178 has an annular groove 180 which defines a manifold 182. This again places all of the slots 176 in fluid communication with each other.

This embodiment illustrates that the invention is applicable to axial flow compressors, as well as radial flow compressors and also that it may be employed on the rotating, accelerating component of the compressor where surge may also be a problem, particularly in axial flow machines.

In the preceding description reference has been made to specific forms of compressors employed in gas turbine engines for pressurizing air in the generation of a high energy, hot gas stream. The broader aspects of the invention are not so limited, but are applicable to any form of rotary compressor for compressible fluids wherein the flow therethrough is divided by vanes or blades, herein generically denominated airfoils, from which the fluid flow may separate in a surge condition.

The spirit and scope of the present inventive concepts is, therefore, to be derived solely from the following claims.

Having thus described the invention, what is claimed as novel and desired to be secured by Letters Patent of the United States is:

1. A compressor stage for pressurizing compressible fluids in a gas turbine engine comprising:

a bladed axial flow impellar, said impellar comprising: a plurality of equally spaced blades mounted about the circumference of a rotor and extending radially outward therefrom, said impellar mounted for rotation within a cylindrical impellar shroud, each of said blades forming a passageway for the axial flow of fluid in conjunction with its adjacent blades;

a flow equalizing system for stabilizing the flow of fluid through the passageways formed by the blades comprising: slots constructed in the outer portion of each blade along a line of equal pressure within the compressor and extending into the blade to communicate with radially inward extending channels constructed within each blade, and a closed manifold chamber constructed within the rotor to interconnect each channel thereby by forming a closed flow system interconnecting each blade passageway.

2. A compressor stage for pressurizing compressible fluids in a gas turbine engine comprising:

a bladed axial flow impellar, said impellar comprising: a plurality of equally spaced blades mounted about the circumference of a rotor and extending radially outward therefrom, said impellar mounted for rotation within a cylindrical impeller shroud, each of said blades forming a passageway for the axial flow of fluid in conjunction with its adjacent blades;

an axial flow diffuser section mounted downstream of the impellar to receive the fluid therefrom, said diffuser section comprising: a plurality of equally spaced vanes mounted about the circumference of an inner substantially cylindrical platform and extending radially outward to engage an outer cylindrical diffuser shroud, each of said vanes forming a passageway for the axial flow of fluid in conjunction with its adjacent vanes; and a flow equalizing system for stabilizing the flow of fluid through the passageways formed by the vanes comprising: slots constructed in the outer portion of each vane along a line of equal pressure within the diffuser and extending into the vane to communicate with radially outward extending channels constructed within each vane, and a closed manifold chamber constructed in the diffuser shroud to interconnect with each of said channels, thereby forming a closed flow system interconnecting each vane passageway.

3. A compressor stage for pressurizing compressible fluids in a gas turbine engine as described in claim 2 wherein the flow equalizing system further comprises slots constructed in the outer portion of each blade along a line of equal pressure in the compressor and extending into the blade to communicate with radially inward extending channels constructed within each blade, and a closed manifold chamber constructed in the rotor to interconnect with each of said channels, thereby forming a closed flow system interconnecting each blade passageway.

* * * * *